US006773060B2

(12) United States Patent
Sher et al.

(10) Patent No.: US 6,773,060 B2
(45) **Date of Patent: *Aug. 10, 2004**

(54) ARM CHAIR MOUNTED KEYBOARD SUPPORT APPARATUS

(76) Inventors: Michael L. Sher, 9311 Benthos St., Houston, TX (US) 77083; Rafael Jakubow, 465 Golden Beach Dr., North Miami, FL (US) 33160; Jim Sher, 5406 Brook Bend, Sugarland, TX (US) 77479

( * ) Notice: Subject to any disclaimer, the term of this patent is extended or adjusted under 35 U.S.C. 154(b) by 0 days.

This patent is subject to a terminal disclaimer.

(21) Appl. No.: 10/076,009

(22) Filed: Feb. 12, 2002

(65) Prior Publication Data

US 2002/0074836 A1 Jun. 20, 2002

Related U.S. Application Data

(63) Continuation-in-part of application No. 09/558,677, filed on Apr. 26, 2000, now Pat. No. 6,354,658.

(51) Int. Cl.[7] ..... A47C 7/68; A47B 83/02

(52) U.S. Cl. ..... 297/188.14; 297/148; 297/149; 297/153; 248/918

(58) Field of Search ..... 297/188.14, 148, 297/149, 153; 248/222.13, 229.21, 231.31, 298.1, 118, 918; 188/152

(56) References Cited

U.S. PATENT DOCUMENTS 3,121,591 A * 2/1964 Micciche ..... 297/153
6,045,179 A * 4/2000 Harrison ..... 248/918 X
6,354,658 B1 * 3/2002 Sher et al. ..... 297/153 X

* cited by examiner

*Primary Examiner*—Rodney B. White
(74) *Attorney, Agent, or Firm*—Frank L. Kubler

(57) ABSTRACT

A chair arm-mounted tray apparatus for mounting on arms of a chair for supporting an item includes an item support deck for supporting an item; and a deck support frame fastened to the support deck, the deck support frame including a chair arm engaging structure for removably securing the apparatus to chair arms, and including laterally spaced apart frame arms removably secured to chair arms by the chair arm engaging structure; the chair arm engaging structure including first and second arm straddles, each of the first and second arm straddles including a substantially U-shaped member including two spaced-apart arm straddle tines defining a set of tines for fitting around one of the chair arms, including a clutch pivot joint at which the given arm straddle connects to the corresponding frame arm.

16 Claims, 14 Drawing Sheets

ARM CHAIR MOUNTED KEYBOARD SUPPORT APPARATUS

FILING HISTORY

This application is a continuation-in-part of application Ser. No. 09/558,677 filed on Apr. 26, 2000 now U.S. Pat. No. 6,354,658.

BACKGROUND OF THE INVENTION

1. Field of the Invention

The present invention relates generally to the field of computers and computer accessories. More specifically the present invention relates to a chair arm-mounted tray apparatus for supporting an item such as a keyboard in front of a user seated on a chair. The tray apparatus includes a panel defining a support deck on which the item is placed and a deck support frame fastened to the deck, the deck support frame having chair arm engaging means which removably secures the apparatus to the arms of a chair. The support frame positions the deck forwardly of the chair at an adjustable height and at an adjustable orientation relative to horizontal for ergonomic positioning of user arms and hands while the user operates a computer keyboard or mouse resting on the deck.

The deck support frame includes parallel and laterally spaced apart telescoping frame arms removably secured to chair arms by the chair arm engaging means. The chair arm engaging means preferably takes the form of first and second arm straddles in the form a U-shaped composite member including a pair of spaced apart straddle tines mounted to a distal arm segment. Both sets point in the same direction so that one set points inwardly toward the center of the chair and one set points away from the center. An extra distal arm segment preferably is also provided with a reversed straddle tine set, so that the reversed set arm segment can be used to complete one arm to point outwardly from the middle of the chair so that both sets point away from each other outwardly from the middle of the chair.

The straddle tines fit around each chair arm. As the frame arms pivot downwardly with their own weight as well as the weight of the deck and supported item, the tines rotate into abutting contact with the upper and lower surfaces of each chair arm, stopping further frame arm pivoting and thus supporting the frame arms and deck as the chair arms project forwardly and upwardly from the seat of the chair. Each arm straddle includes a clutch pivot joint at which the arm straddle engages the adjacent frame arm.

2. Description of the Prior Art

There have been various tray devices for connecting to or hanging from existing structures for supporting a wide variety of items, such as food at a drive-in restaurant. An example of a chair attached computer keyboard holder is found in Trimnell, U.S. Pat. No. 5,893,707, issued on Apr. 13, 1999. A problem with Trimnell is that it connects to a only certain type of chair legs not found on many chairs and is apt to be bumped by user feet. Another example is that of Yancz, et al., U.S. Pat. No. 5,356,059, issued on Oct. 18, 1994 for a basket or tray for attachment to a wheelchair. Once again, the attachment means appear to require the structure of a wheelchair, making its use very limited in the business world.

It is thus an object of the present invention to provide an arm chair mounted item support apparatus which can be removably secured to chair arms which thereby places an item supporting tray in front of a seated user.

It is another object of the present invention to provide such an apparatus which includes means for altering and selecting tray elevation from the user lap.

It is still another object of the present invention to provide such an apparatus which includes means for altering and selecting the tilt of the tray forwardly or rearwardly for maximized ergonomic use.

It is finally an object of the present invention to provide such an apparatus which is light weight, compact to store and transport, sturdy and inexpensive to manufacture.

SUMMARY OF THE INVENTION

The present invention accomplishes the above-stated objectives, as well as others, as may be determined by a fair reading and interpretation of the entire specification.

A chair arm-mounted tray apparatus is provided for mounting on a chair having chair arms with upper and lower chair arm surfaces and having a chair seat, for supporting an item, the apparatus including an item support deck for supporting an item; and a deck support frame fastened to the support deck, the deck support frame including a chair arm engaging structure for removably securing the apparatus to the arms of a chair, and including substantially parallel and laterally spaced apart frame arms removably secured to chair arms by the chair arm engaging structure, each frame arm including a proximal arm segment and a distal arm segment which includes the chair arm engaging structure; the chair arm engaging structure including first and second arm straddles, each of the first and second arm straddles including a substantially U-shaped member including two spaced-apart arm straddle tines defining a set of tines for fitting around one of the chair arms, including a clutch pivot joint at which the given arm straddle connects to the corresponding frame arm, so that as the frame arms pivot downwardly with their own weight and the weight of the support deck, the tines rotate into abutting contact with the upper and lower chair arm surfaces, thereby supporting the frame arms and the support deck.

The sets of straddle tines preferably both point outwardly from the chair. The sets of straddle tines alternatively both point in the same direction so that one set points toward the middle of the chair and the other set points outwardly from the chair. The straddle tines of each set are mounted to opposing ends of an elongate tine hub plate, and the hub plate has two opposing longitudinal hub plate ends including a hub plate axle port and a tine axle bolt passing through each tine axle port and through an axial bore in each straddle tine, so that each straddle tine is rotatably mounted to a hub plate end on a tine axle bolt. Each straddle tine preferably includes an inner tine support structure and an outer tine covering fitted over the inner tine support structure.

Each distal arm segment preferably includes two opposing hollow distal arm segment shells which fit together to form a distal arm segment body defining a mechanism cavity within the distal arm segment body; and where the distal arm segment shells are joined together with fasteners and each clutch pivot joint is contained within one of the mechanism cavities. Each ratchet mechanism preferably includes a ratchet gear having a ratchet gear circumference lined with ratchet teeth and being mounted on a ratchet gear axle mounted within the mechanism cavity, and connected to a corresponding U-shaped member; and a corresponding pawl pivotally mounted on a pawl axle mounted within the mechanism cavity and biased into engaging contact with the ratchet gear circumference by a pawl biasing spring. The chair arm-mounted tray apparatus preferably additionally a pointer element having two opposing pointed ends and port mounted to a corresponding U-shaped member to rotate with straddle tines.

A chair arm-mounted tray apparatus is provided for mounting on a chair having chair arms with upper and lower chair arm surfaces and having a chair seat, for supporting an item, the apparatus including an item support deck for supporting an item; and a deck support frame fastened to the support deck, the deck support frame including chair arm engaging structures for removably securing the apparatus to the arms of a chair, and including substantially parallel and laterally spaced apart frame arms removably secured to chair arms by the chair arm engaging structure, each frame arm including a proximal arm segment and a distal arm segment which includes the chair arm engaging structure; the chair arm engaging structure including first and second arm straddles, each of the first and second arm straddles including a substantially U-shaped member including two spaced-apart arm straddle tines defining a set of tines for fitting around one of the chair arms, including a clutch pivot joint at which the given arm straddle connects to the corresponding frame arm, so that as the frame arms pivot downwardly with their own weight and the weight of the support deck, the tines rotate into abutting contact with the upper and lower chair arm surfaces, thereby supporting the frame arms and the support deck; where the distal arm segments each include a radially protruding distal segment radial stem having a longitudinal radial stem spline, the proximal arm segments each include a radially protruding stem receiving tube containing a longitudinal radial stem spline channel for receiving the radial stem spline, each proximal arm segment further including a proximal segment slide ring portion secured at the segment tube proximal end; where the support deck includes a deck mounting assembly including for each frame arm a deck engaging structure at the arm proximal end with an external clutch tube having longitudinal and an external clutch tube spline slat which removably fits into longitudinal radial spline channel in the external clutch tube, a corresponding arm proximal segment slide ring portion fitted around the external clutch tube, the slide ring portion having internal axial spline groove each receiving an external clutch tube spline slat, so that the slide ring portion is longitudinally slidable along the external clutch tube and not rotatable about the external clutch tube; and an internal clutch tube extending within each one of the external clutch tubes and including an outward clutch segment having an outward clutch segment engaging structure, the outward clutch segment fitting into one of the external clutch tubes having an inward clutch segment having an inward clutch segment engaging structure engaging the outward clutch segment engaging structure of the corresponding the internal clutch tube, the inward and outward clutch segment engaging structure locking the external and internal clutch tubes against axial rotation relative to each other when mutually engaged, and permitting axial rotation relative to each other when disengaged. The chair arm-mounted tray apparatus where the outward clutch segment engaging structure includes a circumferential array of longitudinal outward clutch undulations and where the inward clutch segment engaging structure includes a circumferential array of longitudinal inward clutch undulations which engagingly receive the outward clutch undulations. The chair arm-mounted tray apparatus preferably additionally includes a release cap fitted into an end of each the external clutch tube and bearing against an outward end of the internal clutch tube, the release cap protruding out of the external clutch tube for manual access.

The chair arm-mounted tray apparatus preferably additionally includes a clutch spring biasing the internal clutch tube so that the inward and outward clutch undulations are releasibly biased into mutual registration and engagement, until axial manual pressure against the release cap overcomes the biasing of the spring and slides the outward undulations out of registration with the inward undulations and the external clutch tube and connected the proximal segment radial tube are free to pivot about the internal clutch tube, and thus to pivot the item support deck upward or downward relative to the chair.

The support deck has a deck rearward edge, and the apparatus preferably additionally includes a central deck mount tube segment connected to the deck rearward edge, and a deck tube segment secured to the deck rearward edge substantially coaxially with and spaced apart from the central deck mount tube to define a clutch space, where each external clutch tube containing an internal clutch tube fits into one of the clutch spaces, and each internal clutch tube extends into the central deck mount tube segment and the release cap extends through the adjacent the deck mount tube segment, so that the internal and external clutch tubes are retained.

A chair arm-mounted tray apparatus is further provided for mounting on a chair having chair arms with upper and lower chair arm surfaces and having a chair seat, for supporting an item, the apparatus including an item support deck for supporting an item; a telescoping deck panel, where the support deck additionally includes a deck lower surface and the deck lower surface includes a pair of guide tracks slidably retaining the telescoping deck panel; so that the deck panel is slidable outwardly beyond the support deck for extending the support deck and for slidable underneath the support deck for compact storage; and a deck support frame fastened to the support deck, the deck support frame including a chair arm engaging structure for removably securing the apparatus to the arms of a chair, and including substantially parallel and laterally spaced apart frame arms removably secured to chair arms by the chair arm engaging structures, each frame arm including a proximal arm segment and a distal arm segment which includes the chair arm engaging structure; the chair arm engaging structure including first and second arm straddles, each of the first and second arm straddles including a substantially U-shaped member including two spaced-apart arm straddle tines defining a set of tines for fitting around one of the chair arms, including a clutch pivot joint at which the given the arm straddle connects to the corresponding the frame arm, so that as the frame arms pivot downwardly with their own weight and the weight of the support deck, the tines rotate into abutting contact with the upper and lower chair arm surfaces, thereby supporting the frame arms and the support deck.

The deck panel has edge portions and the guide tracks preferably are each L-shaped protrusions from the deck lower surface oriented to open toward each other and retaining the edge portions. The support deck preferably includes a panel abutment structure and in this instance the deck panel additionally includes a stop structure connected to the deck panel for abutting the deck abutment structure when the deck panel is slid to full extension for stopping the deck panel from sliding entirely out of the guide tracks.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
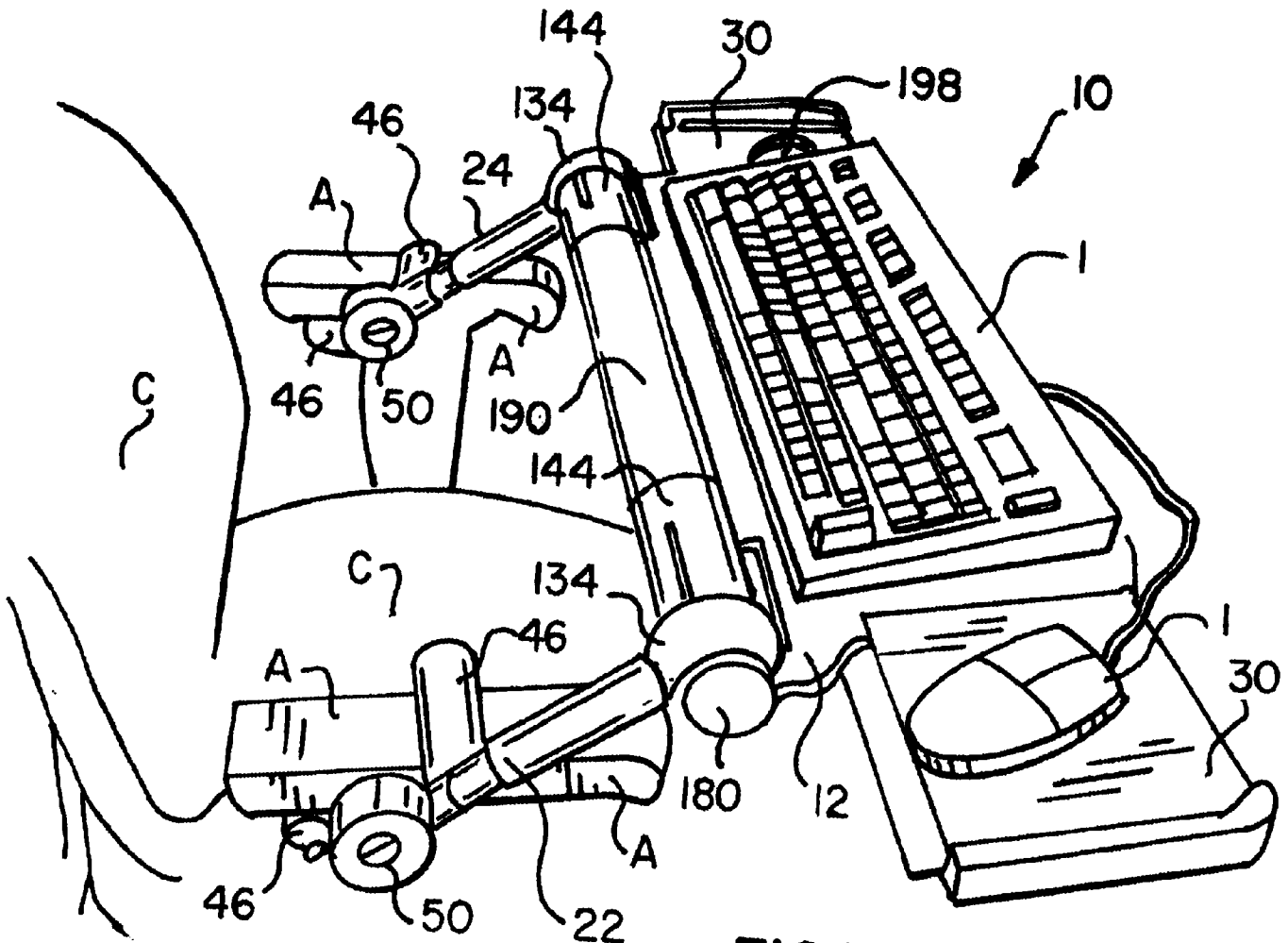
FIG. 1 is a perspective side view of the preferred embodiment of the arm-mounted tray apparatus mounted to arms of a chair and supporting a keyboard and a mouse.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
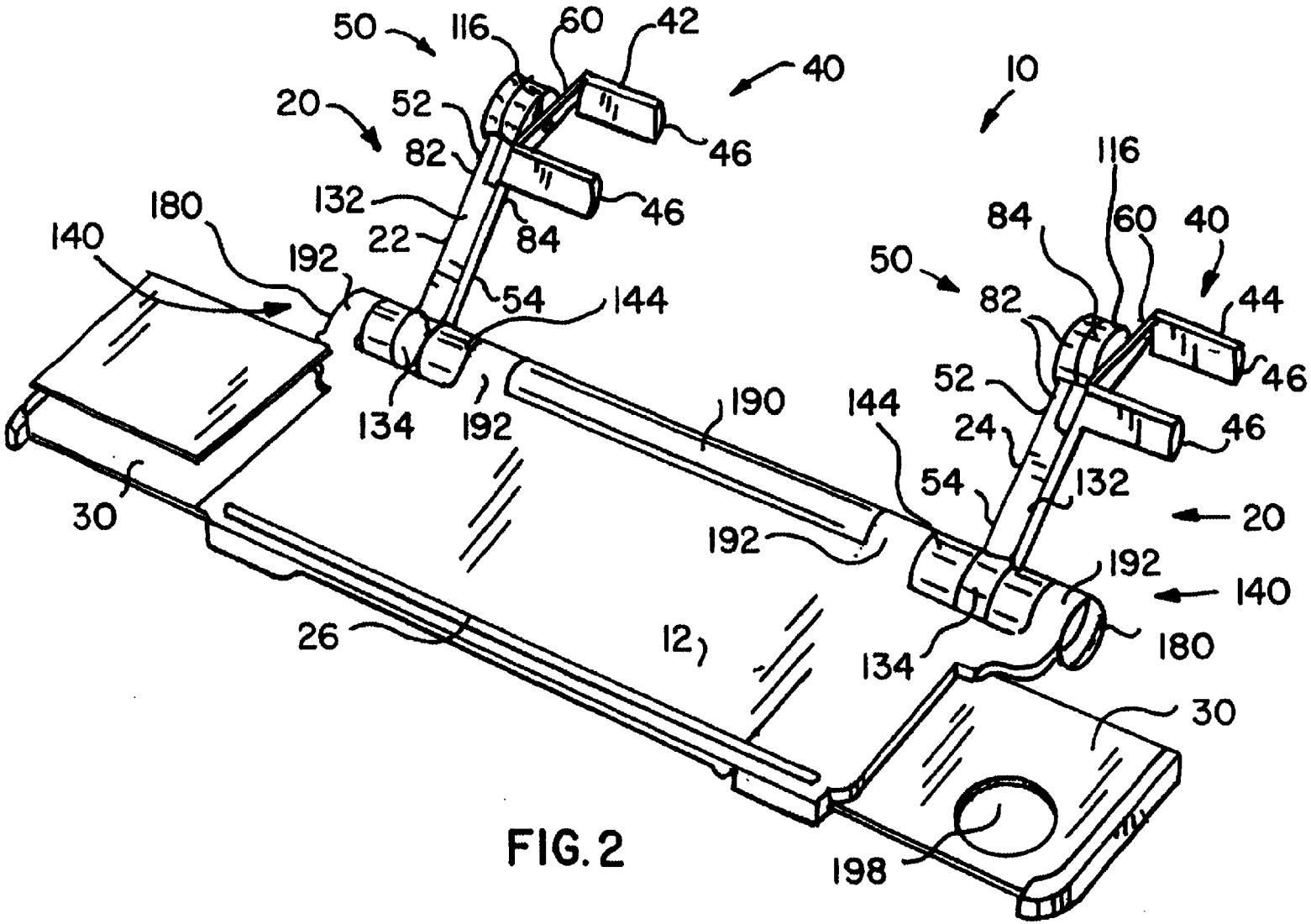
FIG. 2 is a perspective top view of the embodiment of FIG. 1 with the deck panels extended.
Figure 3:
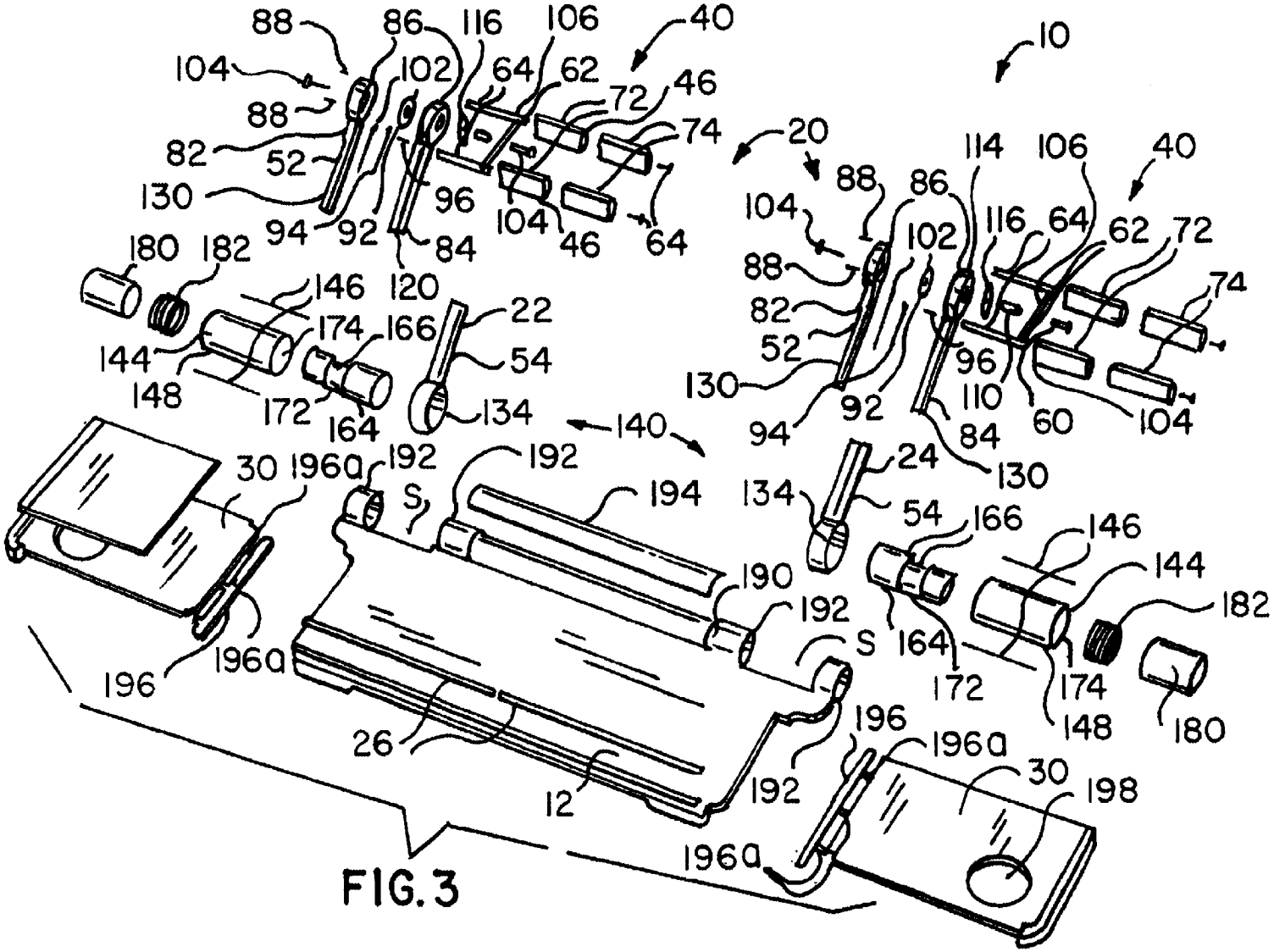
FIG. 3 is an exploded perspective top view of the embodiment of FIG. 2 showing the various preferred elements forming the apparatus and their spatial relationships.
Figure 4:
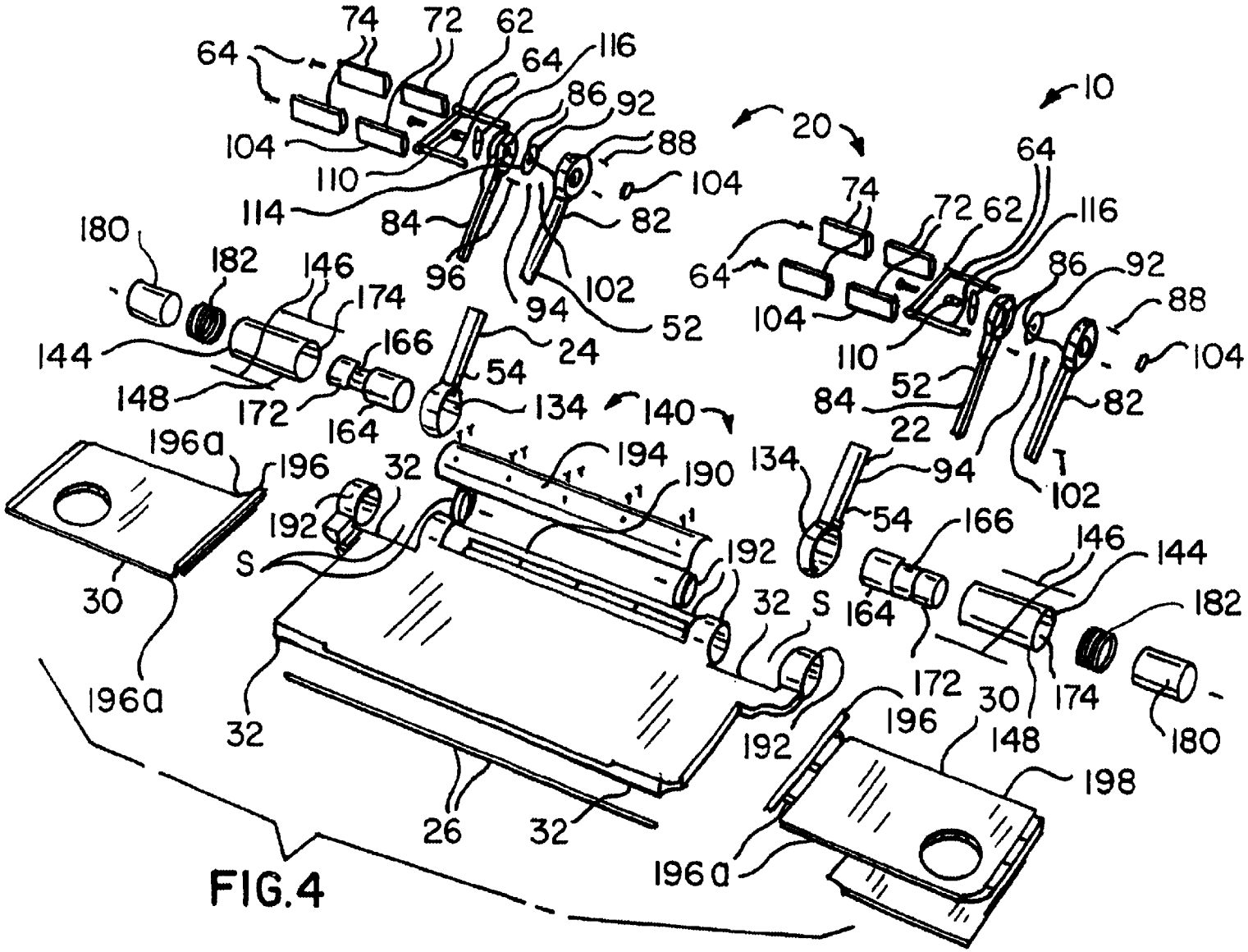
FIG. 4 is an exploded perspective bottom view of the embodiment of FIG. 2 showing the various preferred elements forming the apparatus and their spatial relationships, and revealing the deck panel tracks.
Figure 5:
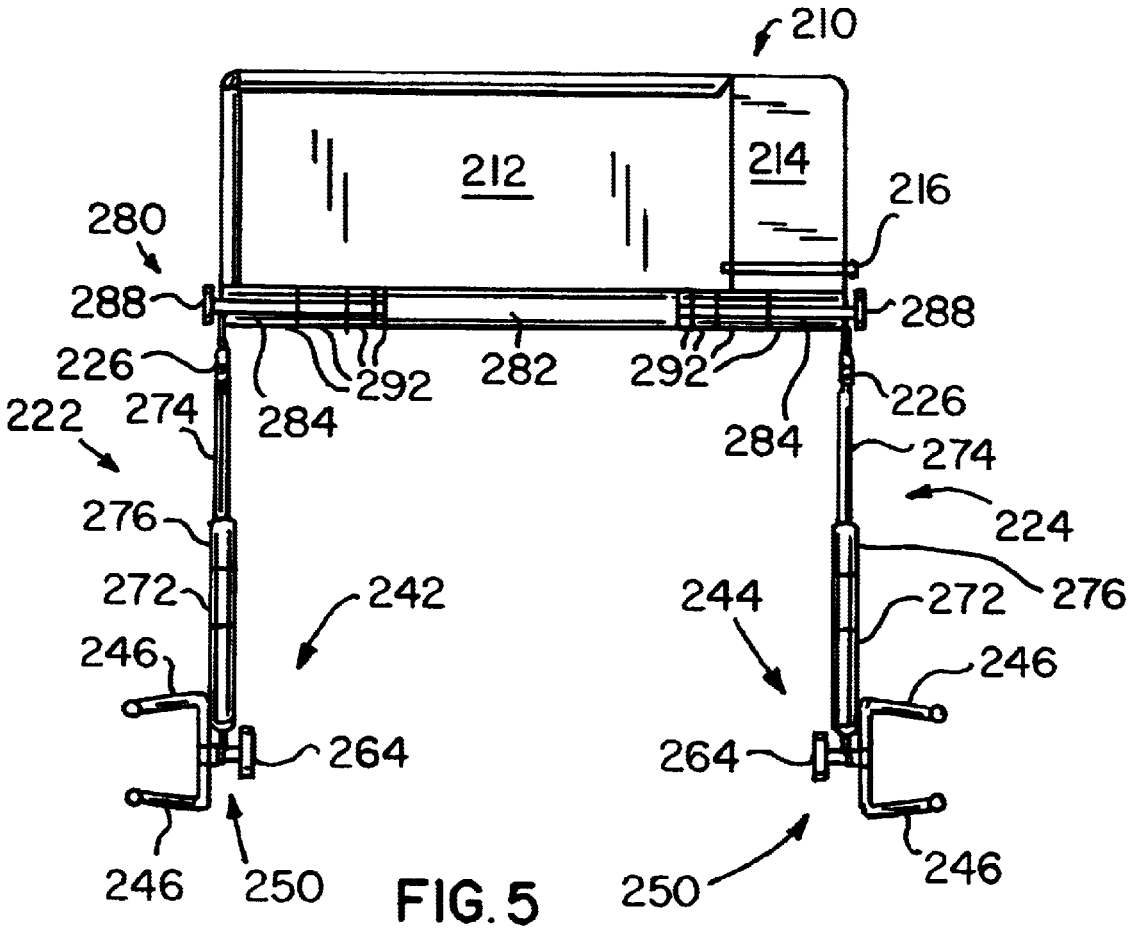
FIG. 5 is a top view of the arm-mounted tray apparatus with the frame arm 224 extended. Note that the numerical prefix "2" or "3" is added to previous reference numerals for these embodiments.
Figure 13:
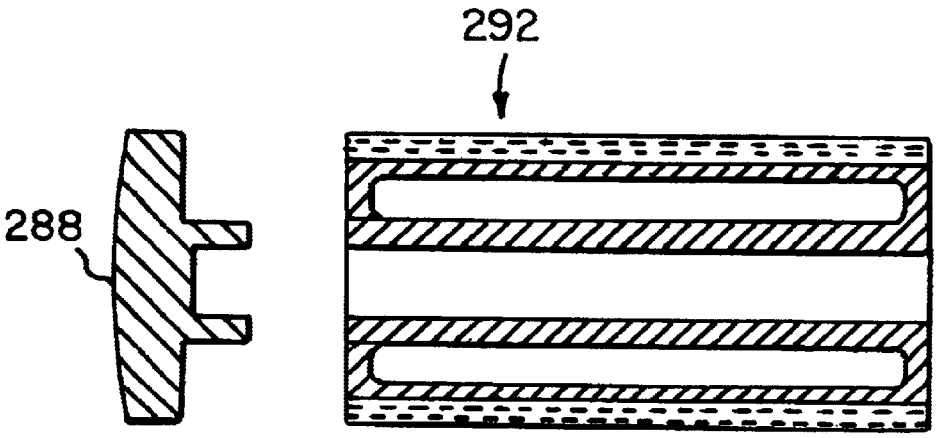
FIG. 13 is a cross-sectional side view of the external clutch tube 292 and its release cap 288.
Figure 6:
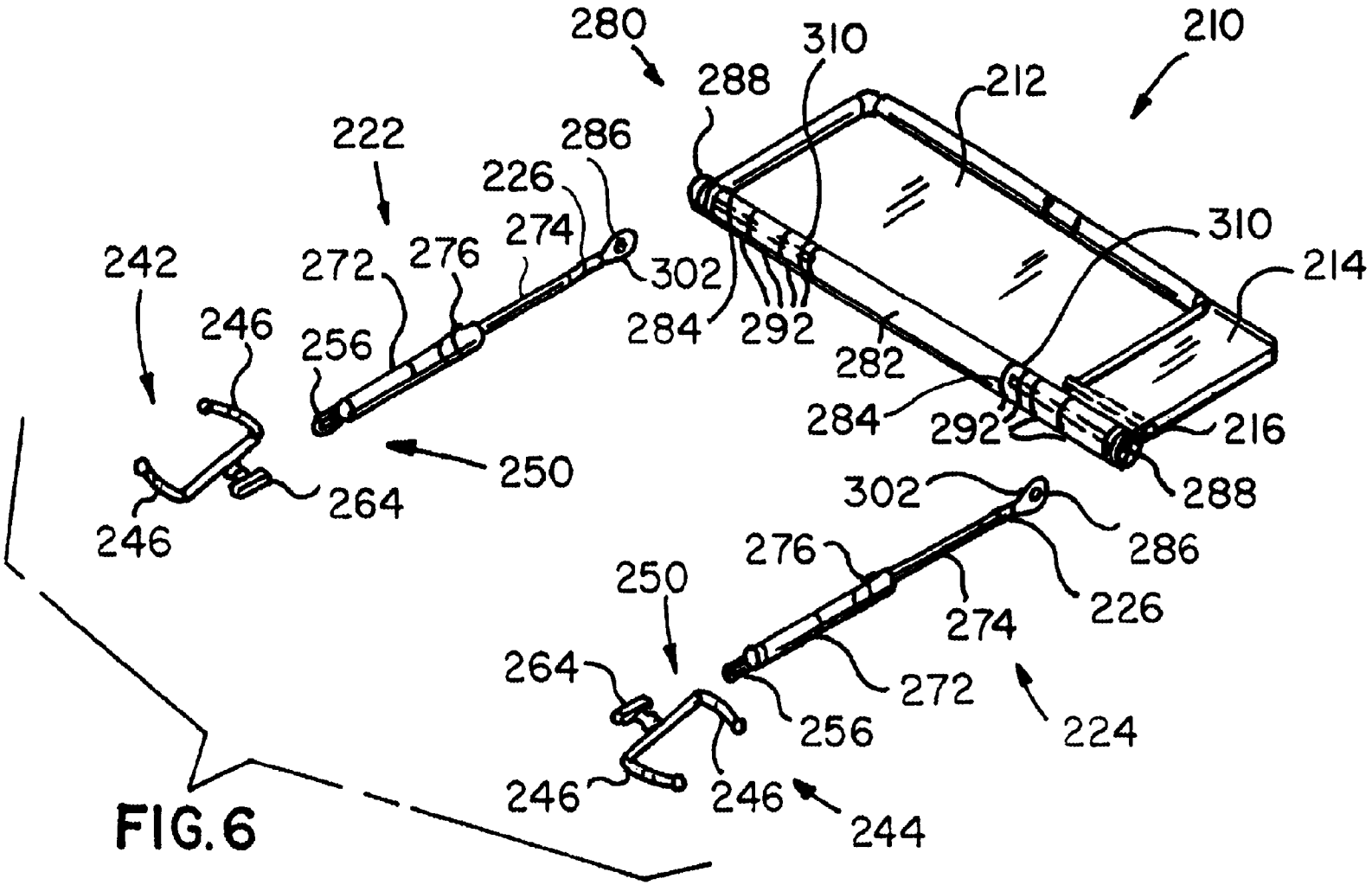
FIG. 6 is a perspective top view of the apparatus of FIG. 5 with the parts of frame arm 224 shown in exploded relation.
Figure 7:
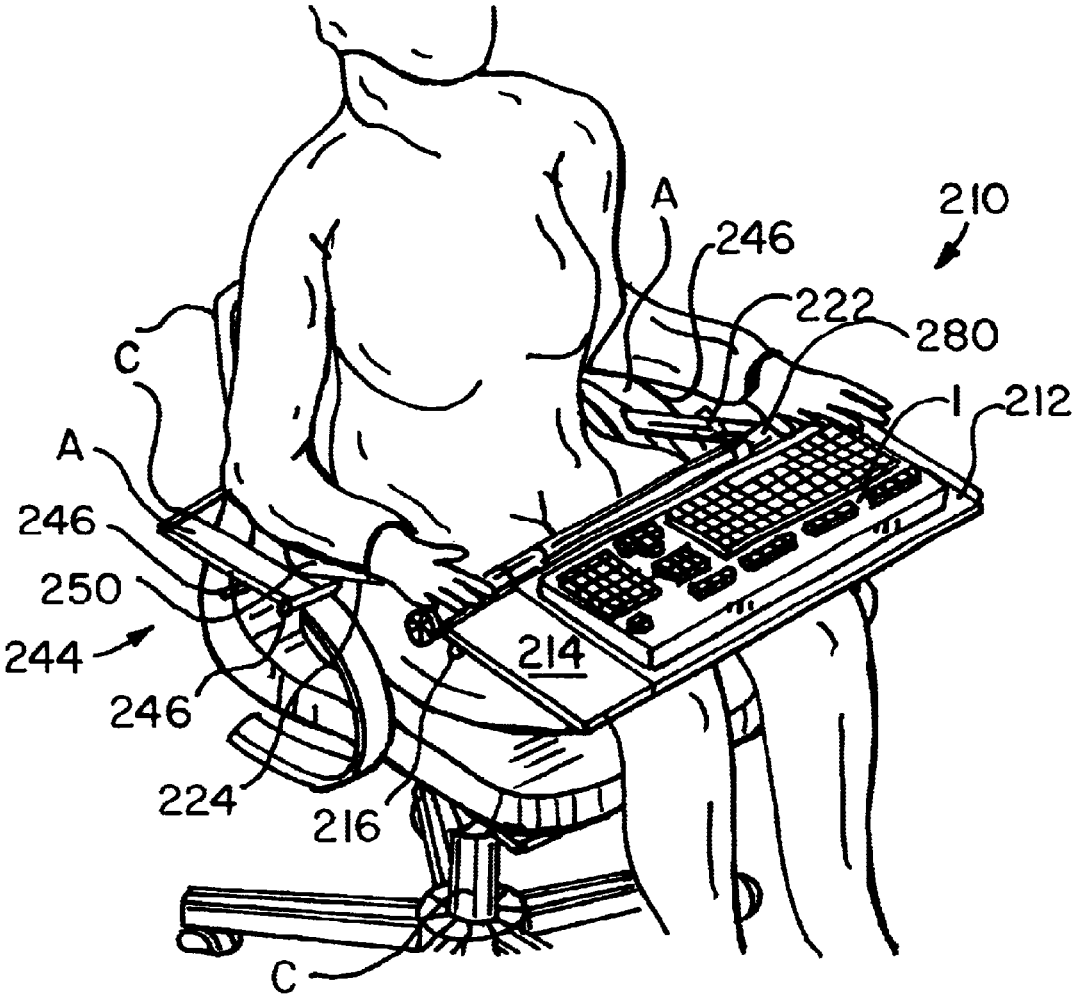
FIG. 7 is a perspective view of the apparatus mounted onto arms of a chair with a keyboard resting on the support deck 214 and with a person seated in the chair ready to use the keyboard.
Figure 8:
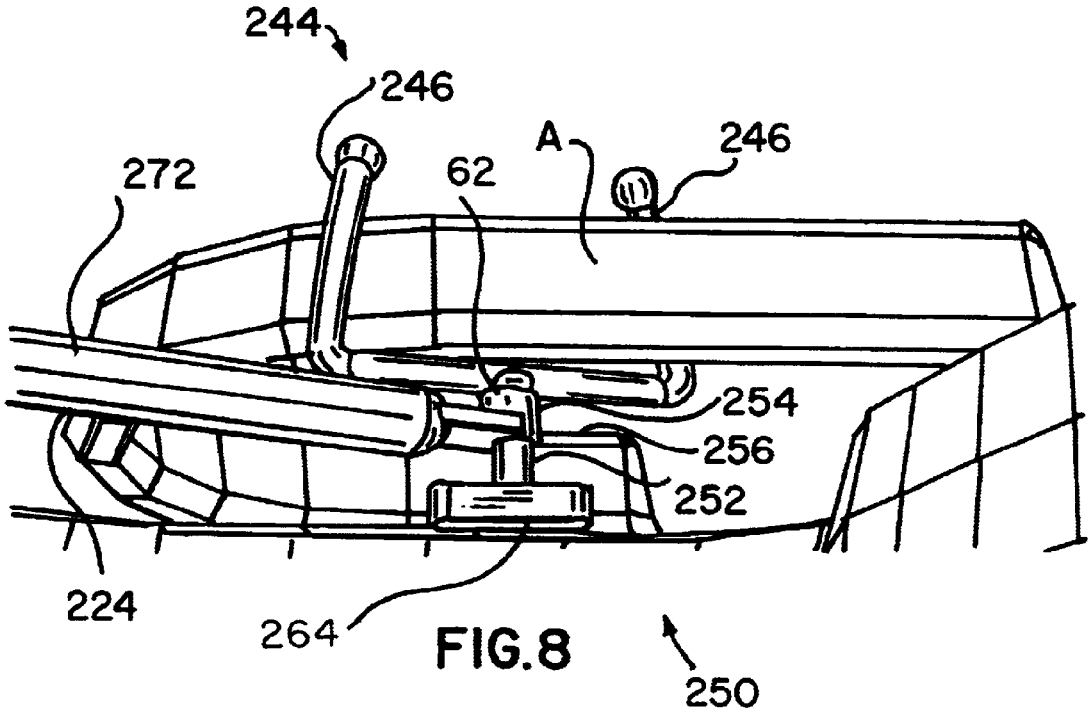
FIG. 8 is a close-up top view of one of the arm straddles of the frame arms 224 engaging a chair arm.
Figure 9:
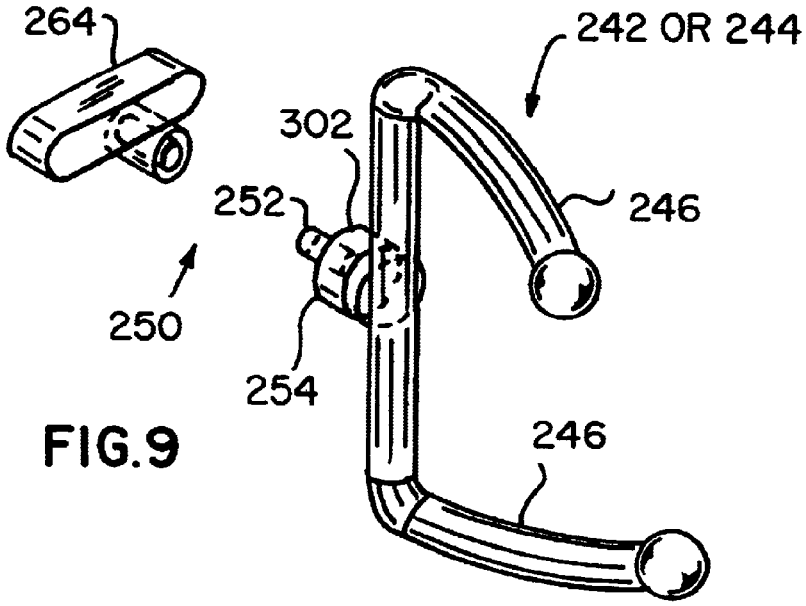
FIG. 9 is an exploded view of an arm straddle 242 or 244 showing the preferred configuration of the tines 246.
Figure 10:
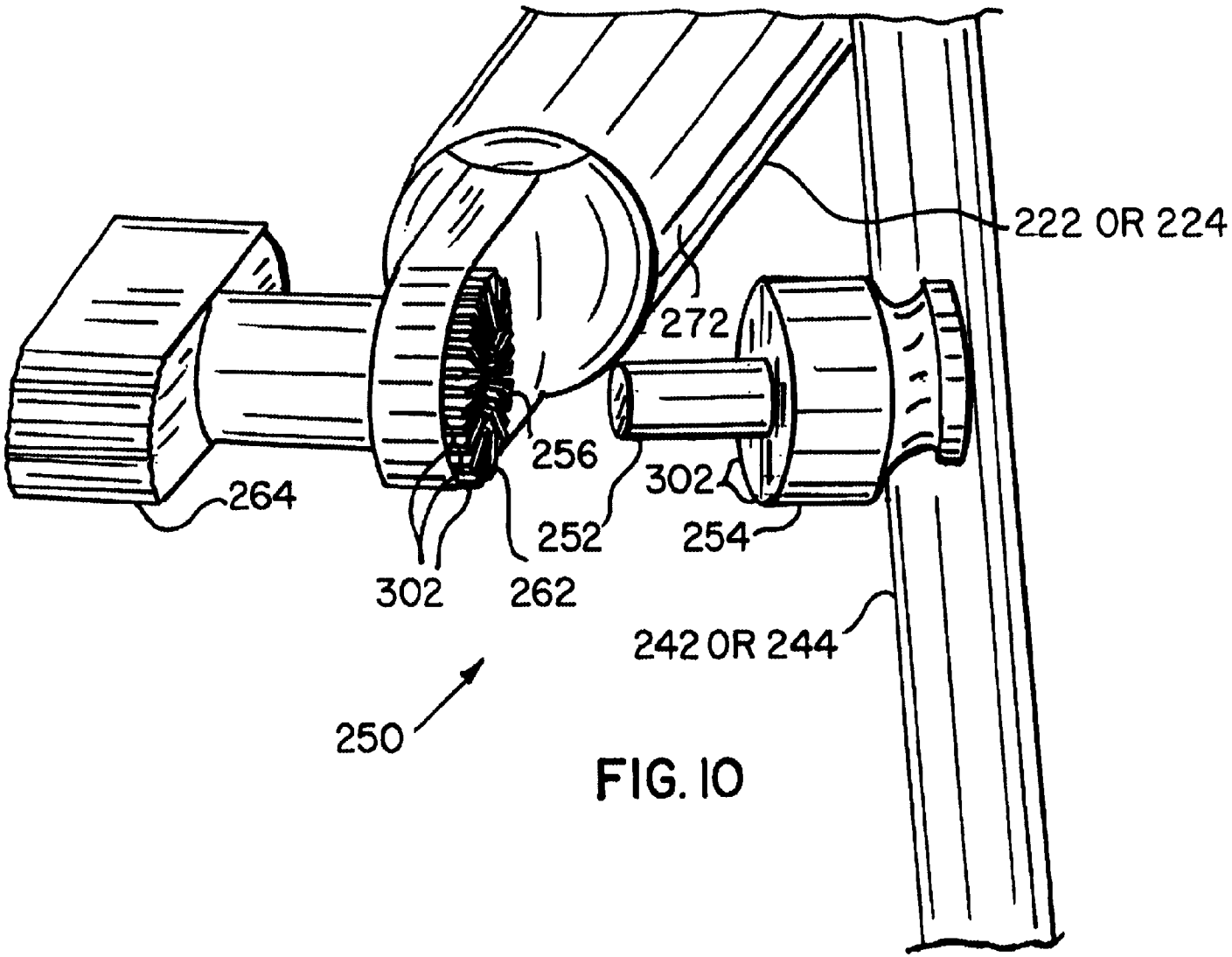
FIG. 10 is a close-up exploded view of a clutch pivot joint 250 or a frame arm 222 or 224.
Figure 11:
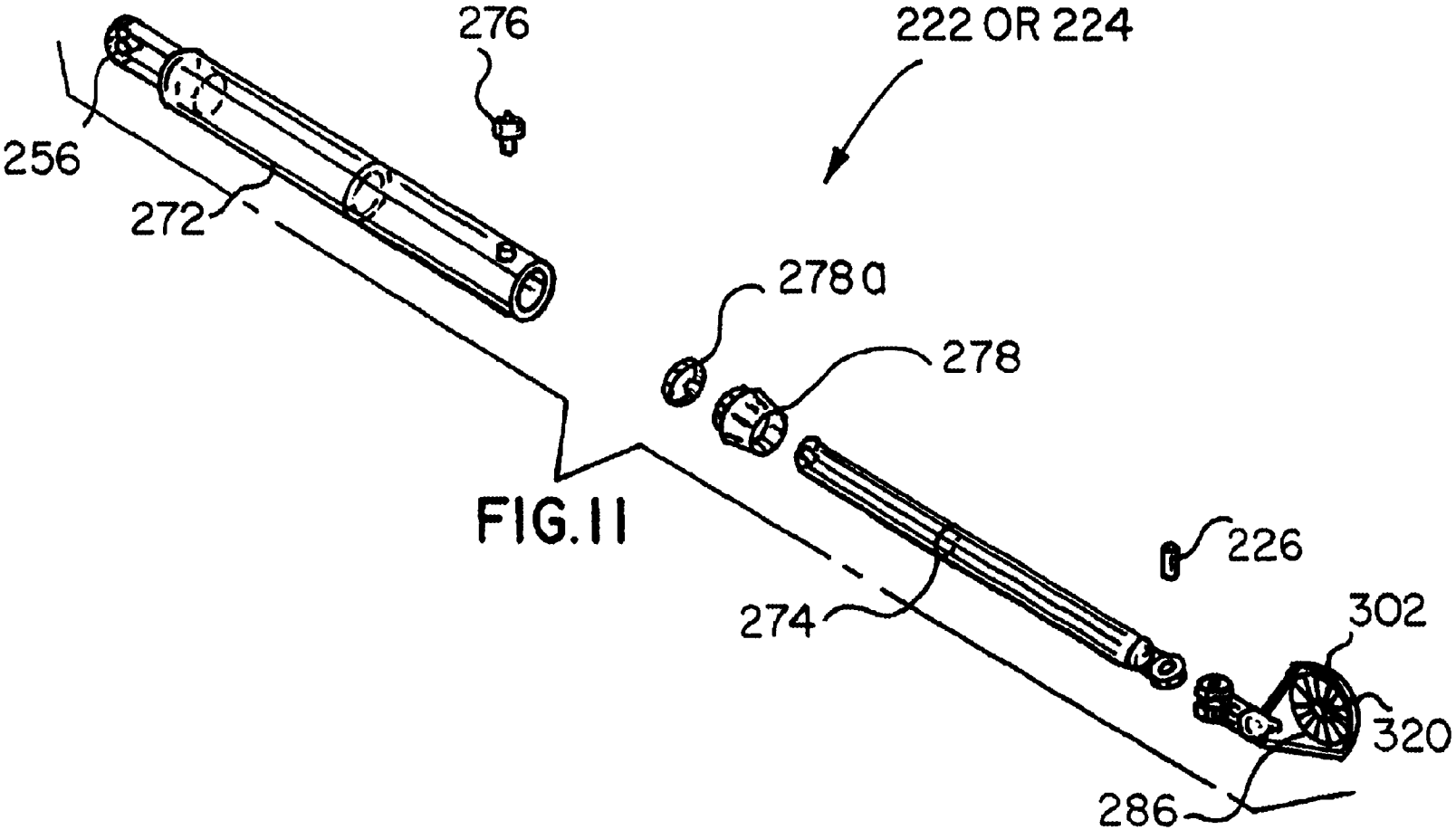
FIG. 11 is a close-up exploded view of a frame arm 222 or 224.
Figure 12:
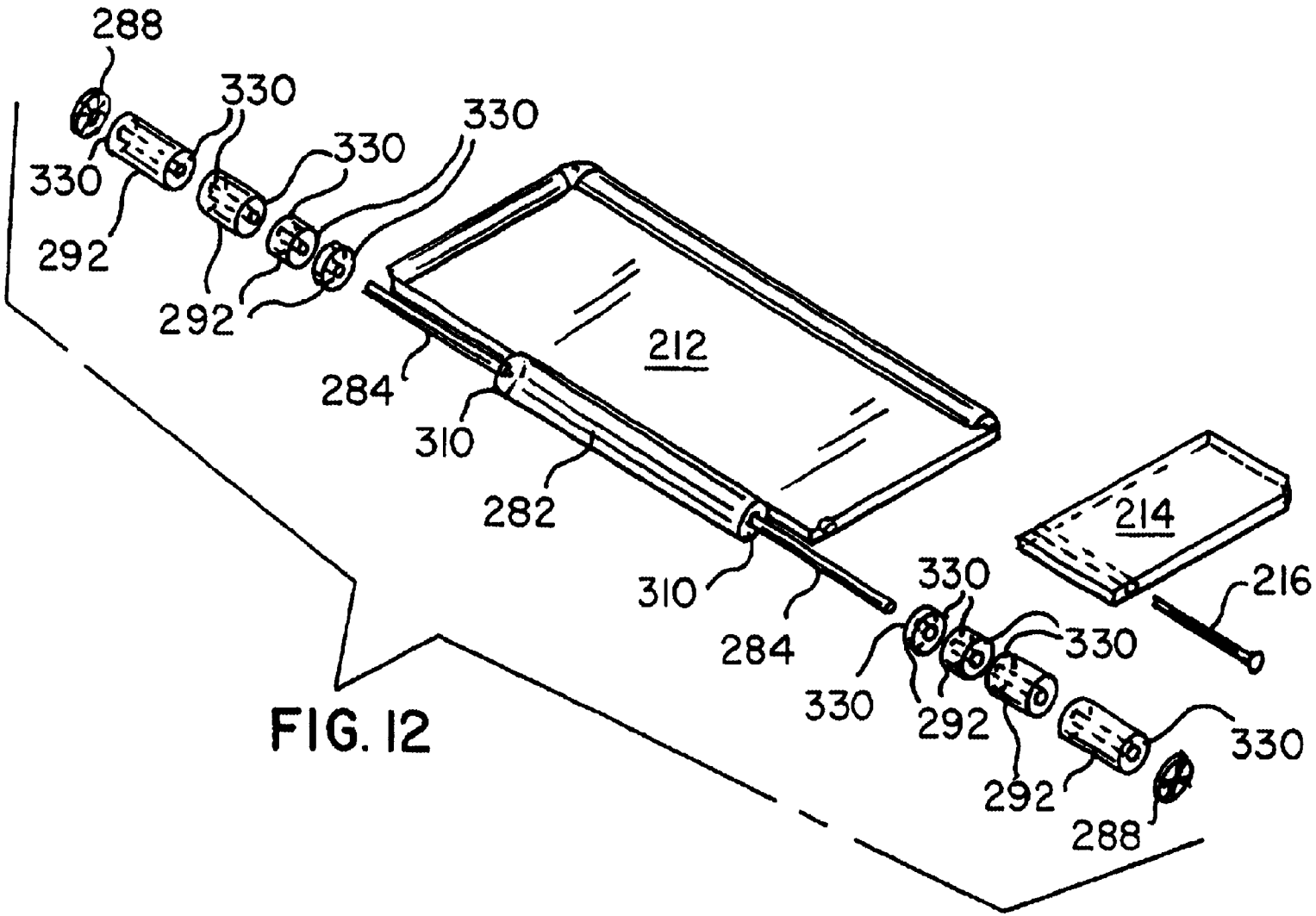
FIG. 12 is an exploded, perspective view of the support deck and support deck rotational position means.
Figure 14:
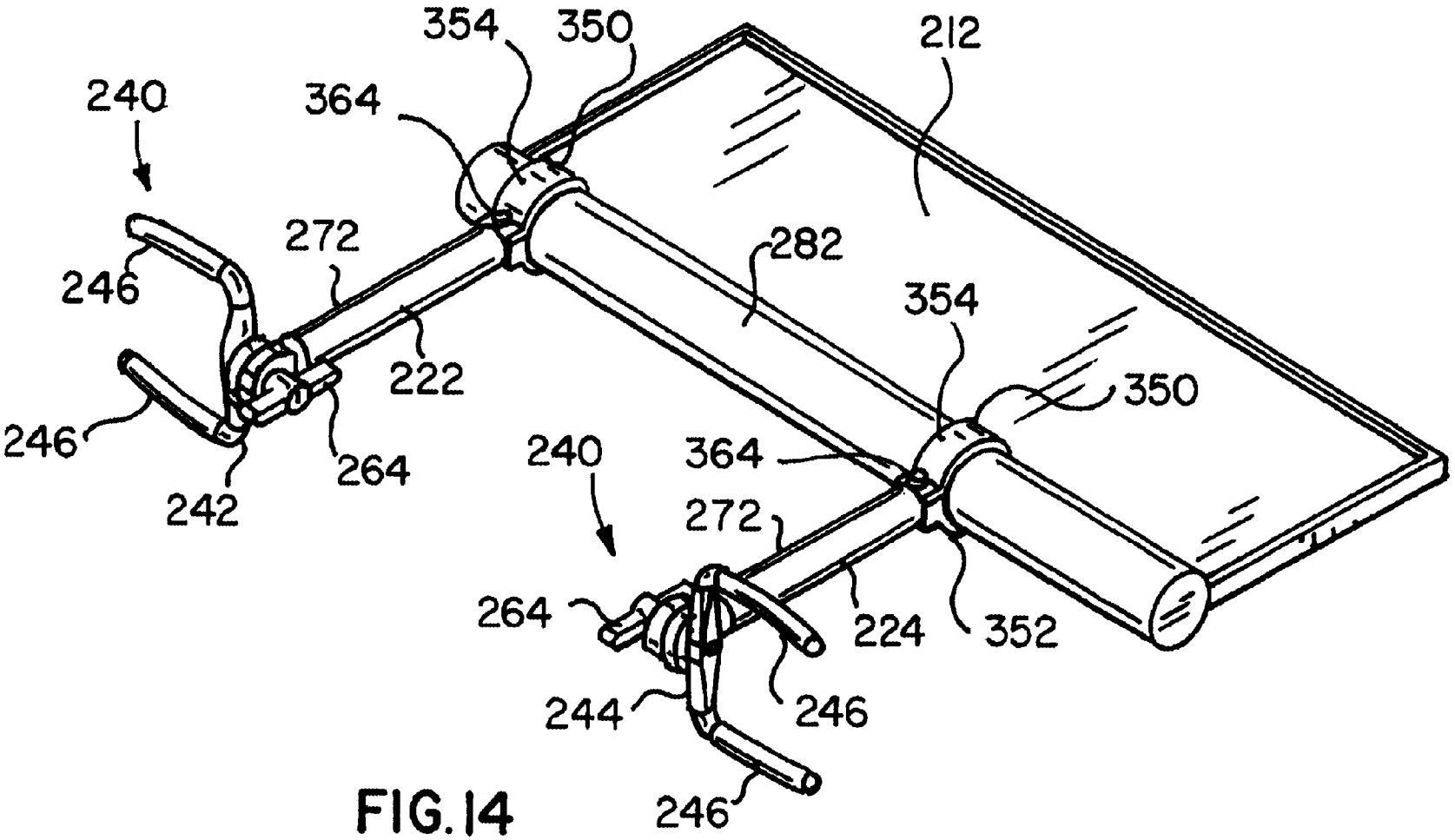
FIG. 14 is an upper perspective view of the apparatus with the frame arm 222 and 224 positioned so that the chair arm engaging means 240 are positioned at a width to engage chair arms spaced apart to a corresponding width.
Figure 15:
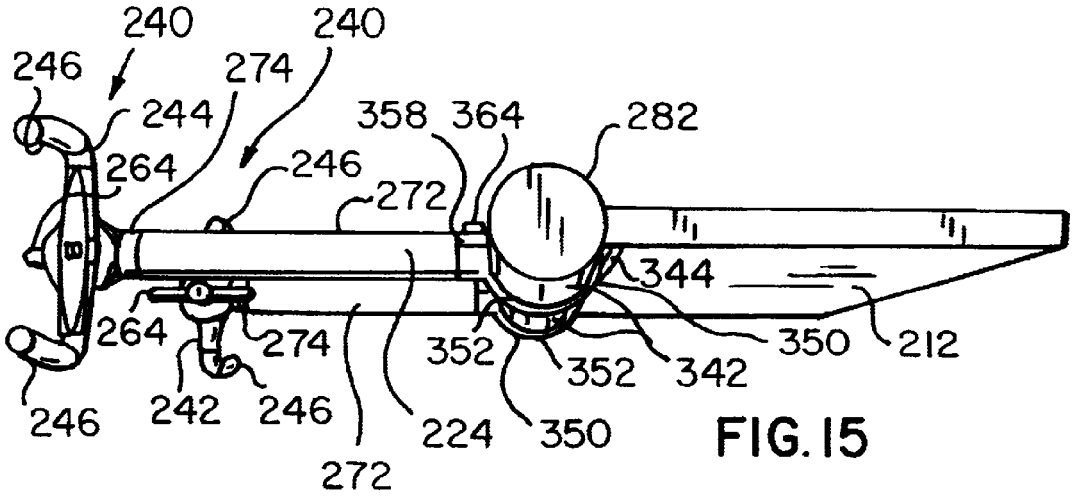
FIG. 15 is a side perspective view of the apparatus of FIG. 14.
Figure 16:
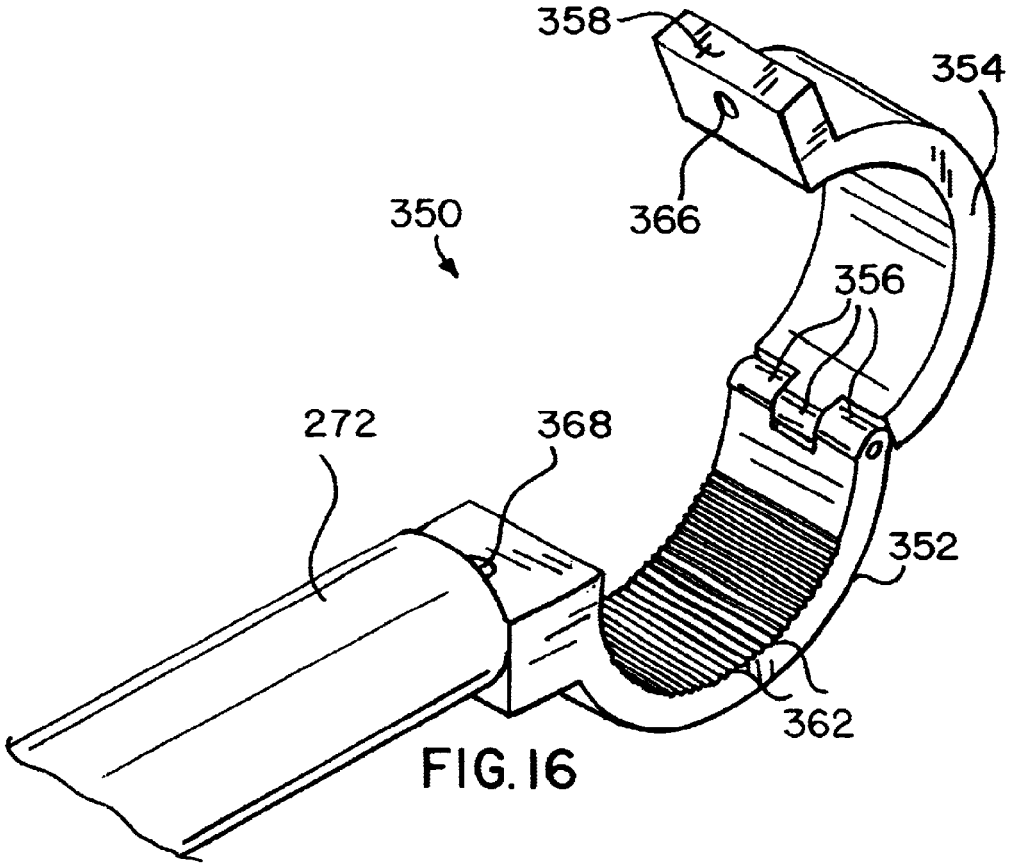
FIG. 16 is close-up view of one of the proximal segment slide ring portion 350.
Figure 17:
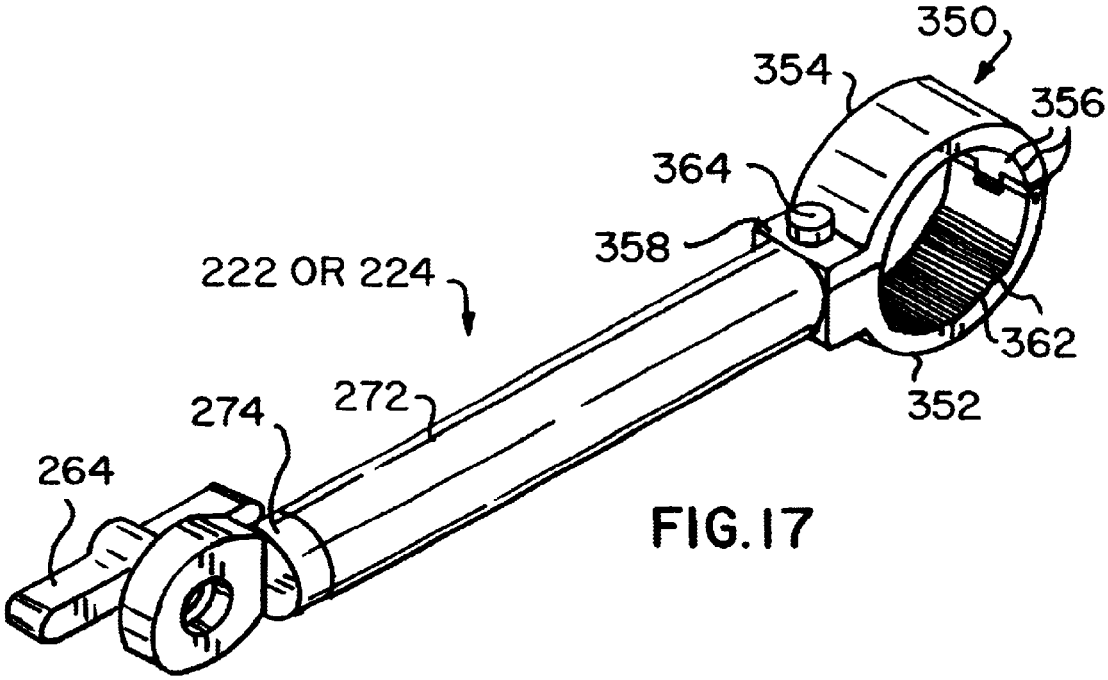
FIG. 17 is a perspective view of one of the frame arms 222 or 224.
Figure 18:
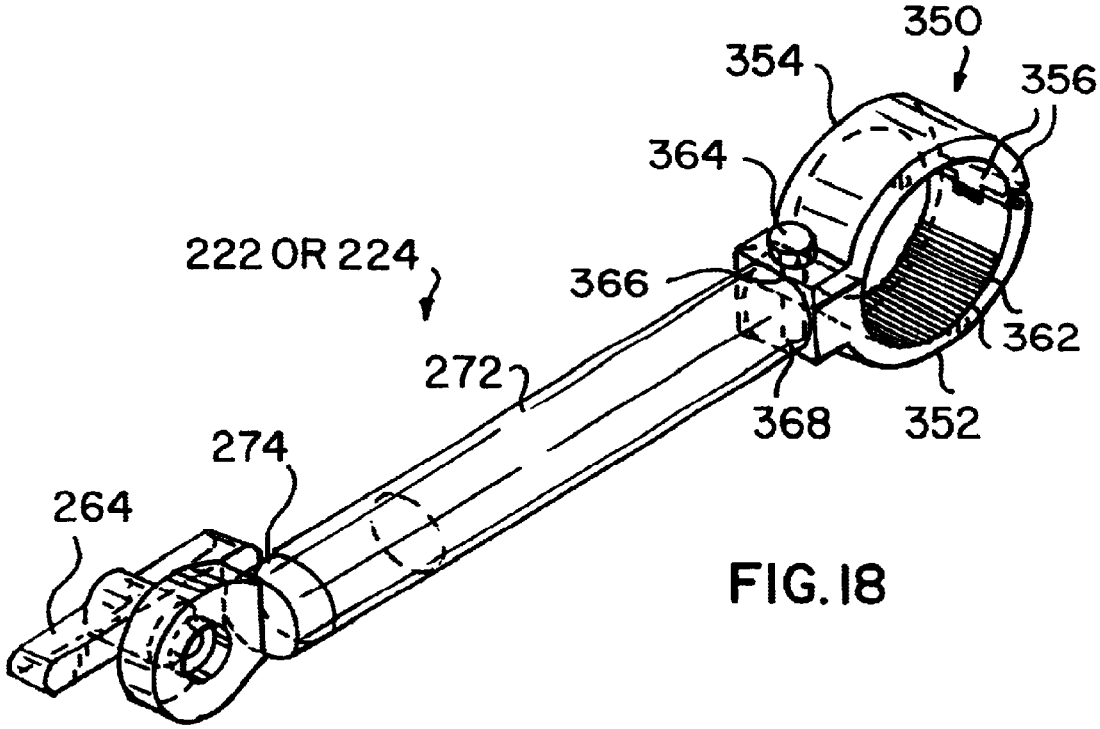
FIG. 18 is a view as in FIG. 17, with hidden structures shown in broken lines.

Referring to FIGS. 1–4, a chair arm-mounted tray apparatus 10 for supporting an item I such as a keyboard in front of a user seated on a chair is disclosed. The supported item I may be a keyboard, a mouse pad, a laptop computer, and alternatively may be a book or a pen and paper.

Tray apparatus 10 includes a panel defining an item support deck 12 on which the item I is placed and a deck support frame 20 fastened to deck 12, the deck support frame 20 having chair arm engaging means 40 which removably secures apparatus 10 to the arms A of a chair C. Deck support frame 20 positions the deck 12 forwardly of the chair C at an adjustable height from the user and at an adjustable orientation relative to horizontal for ergonomic positioning of user arms and hands while the user operates a computer keyboard or mouse resting on deck 12. A pencil retaining strip 26 is preferably secured to the deck 12 upper surface adjacent to the deck 12 distal edge. Deck 12 preferably includes laterally telescoping deck panels 30 each slidably mounted in and extending between two opposing panel guide tracks 32 on the deck 12 lower surface.

Deck support frame 20 includes parallel and laterally spaced apart frame arms 22 and 24, respectively, removably secured to chair arms A by chair arm engaging means 40. Each frame arm 22 and 24 includes a proximal arm segment 52 and a distal arm segment 54 which includes a deck mounting assembly 140. The chair arm engaging means 40 preferably takes the form of first and second arm straddles 42 and 44, respectively, each including a U-shaped member including a pair of spaced-apart arm straddle tines 46. The straddle tines 46 fit around each chair arm A, and the two sets of tines 46 either both point outwardly from the middle of the chair C, or both point in the same direction so that one set is pointing toward the middle of the chair C and the other set is pointing outwardly from the chair C. See FIG. 1. As the frame arms 22 and 24 pivot downwardly with their own weight as well as with the weight of the deck 12 and supported item I, the tines 46 rotate into abutting contact with the upper and lower surfaces of each chair arm A, stopping further frame arm 22 and 24 downward pivoting, thus supporting frame arms 22 and 24 and deck 12 as the frame arms 22 and 24 project forwardly and upwardly from the seat of the chair C. Each arm straddle 42 and 44 includes a clutch pivot joint 50 at which the arm straddle 42 or 44 engages the corresponding frame arm 22 or 24, respectively.

The straddle tines 46 are mounted to opposing ends of an elongate tine hub plate 60. A tine axle port 62 is provided in each end of the hub plate 60 and a tine axle bolt 64 passes through each tine axle port 62 and through an axial bore in each tine 46 so that each tine 46 is secured to the hub plate 60 and rotatably mounted on its tine axle bolt 64. Each tine 46 preferably is a composite of an inner tine support structure 72 and an outer tine covering 74.

The clutch pivot joints 50 are each contained in a mechanism cavity 86 defined by opposing hollow distal arm segment shells 82 and 84 which fit together to form the body of a distal arm segment 54. Arm segment shells 82 and 84 are secured together with arm segment shell screws 88. A ratchet mechanism 90 is fitted into the mechanism cavity 86, and the mechanism cavity 86 containing a ratchet gear 92 and a corresponding pawl 94 pivotally mounted on a pawl axle 96 and biased into engaging contact with the circumference of the ratchet gear 92 by a pawl biasing spring 102.

A hub plate axle bolt 104 is fitted through a hub plate central bolt port 106 in each hub plate 60 and into a bolt tube 110 which in turn extends through an arm segment shell bolt port 112 engagingly into a central gear port 114 in the ratchet gear 92. A pointer element 116 having two opposing pointed ends and a central bolt port 118 preferably is mounted on the bolt tube 110 to rotate with the hub plate 116 and tines 46. Alternatively, use of many other well-known clutch mechanisms are contemplated. A third, reversed distal arm segment 54 is preferably provided with the ratchet mechanism 90 direction of free rotation reversed so that the reversed distal arm segment can replace one of the first two distal arm segments 54 in with the straddle tine 46 orientation also reversed. The reversed straddle tine set distal arm segment 54 can be used to complete one arm 22 or 24 to point outwardly from the middle of the chair C so that both straddle tine 46 sets point away from each other outwardly from the middle of the chair C.

The distal arm segments 54 each include a radially protruding distal segment radial stem 130 longitudinal stem spline which fits into a radially protruding stem receiving proximal segment radial tube 132 tube channel having a proximal segment slide ring portion 134 secured at the segment tube 132 proximal end.

The deck 12 includes the deck mounting assembly 140, which takes the form of an arm proximal end engaging structure 142 including an external clutch tube 144 having longitudinal and external clutch tube spline slats 146 which removably fit into longitudinal channels 148 in the external clutch tube 144. A corresponding arm proximal segment slide ring portion 162 fits around the external clutch tube 144, the ring portion 162 having internal axial spline grooves 168 which each receive an external clutch tube spline slat 146, so that the ring portion 162 is longitudinally slidable along the external clutch tube 144 but not rotatable about the external clutch tube 144.

An internal clutch tube 164 is provided for each of the external clutch tubes 144 and includes an outward clutch segment 166 having a circumferential array of longitudinal outward clutch undulations 172. The outward clutch segment 166 fits into an external clutch tube 144 having an inward clutch segment 176 made up of a circumferential array of longitudinal inward clutch undulations 174 which engagingly receive the outward clutch undulations 172 of the internal clutch tube 164, the inward and outward clutch undulations 174 and 172, respectively, locking the external and internal clutch tubes 144 and 164 against axial rotation relative to each other when mutually engaged, and permitting axial rotation relative to each other when disengaged. A release cap 180 is fitted into an end of the external clutch tube 144 and bears against an outward end of the internal clutch tube 164, the release cap 180 protruding out of the external clutch tube 144 for manual access. A clutch spring 182 biases the internal clutch tube 164 so that the inward and outward clutch undulations 174 and 172 are releasibly biased into mutual registration and engagement until axial manual pressure against the release cap overcomes the spring 182 biasing and slides the outward undulations 172 out of registration with the inward undulations 174 and the external clutch tube 144 and connected proximal segment radial tube 132 are free to pivot about the internal clutch tube 164, and thus to pivot the item support deck 12 upward or downward relative to the chair C. The assembled internal and external clutch tubes 164 and 144 together fit into a clutch space S between a central deck mount tube segment 190 connected to the rearward edge of support deck 12 and one of two laterally located end deck mount tube segments 192. The internal clutch tube 164 extends into the central deck mount tube segment 190 and the release cap 180 extends through the adjacent end deck mount tube segments 192, so that the combined internal and external clutch tubes 164 and 144 are retained. An arched wall segment 194 of the central deck mount tube segment 190 preferably is removably fastened to the remainder of the central deck mount tube segment 190.

The guide tracks 32 slidably retain each of the laterally telescoping deck panels 30, and each set of two guide tracks 32 preferably are each L-shaped protrusions from the deck 12 lower surface and are oriented to open toward each other. A stop bar 196 is provided for each deck panel 30 having stop bar tabs 196*a* which are fastened to the respective deck panels 30 after deck panels 30 are inserted into their corresponding guide tracks 32 to stop the deck panels 30 from sliding entirely out of the guide tracks 32 after the deck panels 30 each reach their full extension. One deck panel preferably includes a drink container retaining port 198. A second embodiment of apparatus 10 is contemplated in which only one frame arm 22 is provided.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A chair and tray apparatus for supporting an item, comprising:

a chair having chair arms with upper and lower chair arm surfaces and having a chair seat spaced apart from said lower chair arm surface;

an item support deck for supporting an item;

and a deck support frame fastened to said support deck, said deck support frame comprising chair arm engaging means for removably securing said apparatus to the arms of said chair, and comprising substantially parallel and laterally spaced apart frame arms removably secured to said chair arms by said chair arm engaging means, each said frame arm including a proximal arm segment and a distal arm segment which includes said chair arm engaging means;

said chair arm engaging means comprising first and second arm straddles, each of said first and second arm straddles comprising a substantially U-shaped member including two spaced-apart arm straddle tines defining a set of tines for fitting around one of the said chair arms, including a clutch pivot joint at which the given said arm straddle connects to the corresponding said frame arm, such that as said frame arms pivot downwardly with their own weight and the weight of said support deck, said tines rotate into abutting contact with said upper and lower chair arm surfaces, thereby supporting said frame arms and said support deck.

2. The chair and tray apparatus of claim 1, wherein said sets of straddle tines both point outwardly from the chair.

3. The chair and tray apparatus of claim 1, wherein said sets of straddle tines both point in the same direction such that one said set points toward the middle of the chair and the other said set points outwardly from the chair.

4. The chair and tray apparatus of claim 1, wherein said straddle tines of each said set are mounted to opposing ends of an elongate tine hub plate, and wherein said hub plate has two opposing longitudinal hub plate ends comprising a hub plate axle port and a tine axle bolt passing through each said tine axle port and through an axial bore in each said straddle tine, such that each said straddle tine is rotatably mounted to a hub plate end on a tine axle bolt.

5. The chair and tray apparatus of claim 4, wherein each said straddle tine comprises an inner tine support structure and an outer tine covering fitted over said inner tine support structure.

6. The chair and tray apparatus of claim 1, wherein each said distal arm segment comprises two opposing hollow distal arm segment shells which fit together to form a distal arm segment body defining a mechanism cavity within said distal arm segment body; and wherein said distal arm segment shells are joined together with fastener means and each said clutch pivot joint is contained within one of said mechanism cavities.

7. The chair and tray apparatus of claim 6, wherein said ratchet mechanism comprises:

a ratchet gear having a ratchet gear circumference lined with ratchet teeth and being mounted on a ratchet gear axle mounted within said mechanism cavity, and connected to a corresponding said U-shaped member; and a corresponding pawl pivotally mounted on a pawl axle mounted within said mechanism cavity and biased into engaging contact with said ratchet gear circumference by a pawl biasing spring.

8. The chair and tray apparatus of claim 6, additionally a pointer element having two opposing pointed ends and port mounted to a corresponding said U-shaped member to rotate with said straddle tines.

9. A chair and tray apparatus for supporting an item, comprising:

a chair having chair arms with upper and lower chair arm surfaces and having a chair seat spaced apart from said lower chair arm surface;

an item support deck for supporting an item;

and a deck support frame fastened to said support deck, said deck support frame comprising chair arm engaging means for removably securing said apparatus to the arms of said chair, and comprising substantially parallel and laterally spaced apart frame arms removably secured to said chair arms by said chair arm engaging means, each said frame arm including a proximal arm segment and a distal arm segment which includes said chair arm engaging means;

said chair arm engaging means comprising first and second arm straddles, each of said first and second arm straddles comprising a substantially U-shaped member including two spaced-apart arm straddle tines defining a set of tines for fitting around one of the chair arms, including a clutch pivot joint at which the given said arm straddle connects to the corresponding said frame arm, such that as said frame arms pivot downwardly with their own weight and the weight of said support deck, said tines rotate into abutting contact with the upper and lower chair arm surfaces, thereby supporting said frame arms and said support deck;

wherein said distal arm segments each comprise a radially protruding distal segment radial stem having a longitudinal radial stem spline said proximal arm segments each comprise a radially protruding stem receiving tube containing a longitudinal radial stem spline channel for receiving said radial stem spline, each said proximal arm segment further comprising a proximal segment slide ring portion secured at the segment tube proximal end;

wherein said support deck comprises a deck mounting assembly including for each said frame arm a deck engaging structure at the arm proximal end with an external clutch tube having longitudinal and an external clutch tube spline slat which removably fits into longitudinal radial spline channel in said external clutch tube, a corresponding arm proximal segment slide ring portion fitted around said external clutch tube, said slide ring portion having internal axial spline groove each receiving an external clutch tube spline slat, such that said slide ring portion is longitudinally slidable along said external clutch tube and not rotatable about said external clutch tube;

and an internal clutch tube extending within each one of said external clutch tubes and including an outward clutch segment having outward clutch segment engaging means, said outward clutch segment fitting into one of said external clutch tubes having an inward clutch segment having inward clutch segment engaging means engaging said outward clutch segment engaging means of the corresponding said internal clutch tube, said inward and outward clutch segment engaging means locking said external and internal clutch tubes against axial rotation relative to each other when mutually engaged, and permitting axial rotation relative to each other when disengaged.

10. The chair and tray apparatus of claim 9, wherein said outward clutch segment engaging means comprises a circumferential array of longitudinal outward clutch undulations and wherein said inward clutch segment engaging means comprise a circumferential array of longitudinal inward clutch undulations which engagingly receive said outward clutch undulations.

11. The chair and tray apparatus of claim 10, additionally comprising a release cap fitted into an end of each said external clutch tube and bearing against an outward end of said internal clutch tube, said release cap protruding out of said external clutch tube for manual access.

12. The chair and tray apparatus of claim 11, wherein said support deck has a deck rearward edge, additionally comprising a central deck mount tube segment connected to said deck rearward edge, and a deck tube segment secured to said deck rearward edge substantially coaxially with and spaced apart from said central deck mount tube to define a clutch space, wherein each said external clutch tube containing an internal clutch tube fits into one of said clutch spaces, and each said internal clutch tube extends into said central deck mount tube segment and said release cap extends through the adjacent said deck mount tube segment, such that said internal and external clutch tubes are retained.

13. The chair and tray apparatus of claim 10, additionally comprising clutch spring means biasing said internal clutch tube such that said inward and outward clutch undulations are releasibly biased into mutual registration and engagement, until axial manual pressure against said release cap overcomes the biasing of said spring means and slides said outward undulations out of registration with said inward undulations and said external clutch tube and connected said proximal segment radial tube are free to pivot about said internal clutch tube, and thus to pivot said item support deck upward or downward relative to the chair.

14. A chair and tray apparatus for supporting an item, comprising:

a chair having chair arms with upper and lower chair arm surfaces and having a chair seat spaced apart from said lower chair arm surface;

an item support deck for supporting an item;

a telescoping deck panel, wherein said support deck additionally comprises a deck lower surface and said deck lower surface comprises a pair of guide tracks slidably retaining said telescoping deck panel;

such that said deck panel is slidable outwardly beyond said support deck for extending said support deck and for slidable underneath said support deck for compact storage;

and a deck support frame fastened to said support deck, said deck support frame comprising chair arm engaging means for removably securing said apparatus to the arms of said chair, and comprising substantially parallel and laterally spaced apart frame arms removably secured to said chair arms by said chair arm engaging means, each said frame arm including a proximal arm segment and a distal arm segment which includes said chair arm engaging means;

said chair arm engaging means comprising first and second arm straddles, each of said first and second arm straddles comprising a substantially U-shaped member including two spaced-apart arm straddle tines defining a set of tines for fitting around one of the chair arms, including a clutch pivot joint at which the given said arm straddle connects to the corresponding said frame arm, such that as said frame arms pivot downwardly with their own weight and the weight of said support deck, said tines rotate into abutting contact with the upper and lower chair arm surfaces, thereby supporting said frame arms and said support deck.

15. The chair and tray apparatus of claim 14, wherein said deck panel has edge portions and wherein said guide tracks are each L-shaped protrusions from said deck lower surface oriented to open toward each other and retaining said edge portions.

16. The chair and tray apparatus of claim 14, wherein said support deck comprises panel abutment means and wherein said deck panel additionally comprises a stop structure connected to said deck panel for abutting said deck abutment means when said deck panel is slid to full extension for stopping said deck panel from sliding entirely out of said guide tracks.

* * * * *